US011430599B2

(12) United States Patent
Okabe et al.

(10) Patent No.: US 11,430,599 B2
(45) Date of Patent: Aug. 30, 2022

(54) TRANSFORMER IRON CORE

(71) Applicant: JFE STEEL CORPORATION, Chiyoda-ku Tokyo (JP)

(72) Inventors: Seiji Okabe, Tokyo (JP); Takeshi Omura, Tokyo (JP); Hirotaka Inoue, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 307 days.

(21) Appl. No.: 16/486,505

(22) PCT Filed: Mar. 29, 2018

(86) PCT No.: PCT/JP2018/013490
§ 371 (c)(1),
(2) Date: Aug. 16, 2019

(87) PCT Pub. No.: WO2018/181831
PCT Pub. Date: Oct. 4, 2018

(65) Prior Publication Data

US 2020/0051731 A1 Feb. 13, 2020

(30) Foreign Application Priority Data

Mar. 30, 2017 (JP) ..... JP2017-068235

(51) Int. Cl.
*H01F 27/245* (2006.01)

(52) U.S. Cl.
CPC ..... *H01F 27/245* (2013.01)

(58) Field of Classification Search
CPC ..... H01F 1/16; H01F 3/02; H01F 3/10; H01F 27/245; H01F 27/33; H01F 27/385; H01F 2003/106
See application file for complete search history.

(56) References Cited

U.S. PATENT DOCUMENTS

| | | | |
|---|---|---|---|
| 4,100,521 A | 7/1978 | Hori | |
| 5,371,486 A | 12/1994 | Yamada et al. | |
| 9,443,648 B2 | 9/2016 | Sawa et al. | |
| 2014/0239892 A1 | 8/2014 | Sawa et al. | |

FOREIGN PATENT DOCUMENTS

| | | | |
|---|---|---|---|
| CN | 103918048 A | | 7/2014 |
| JP | S5056928 U | | 5/1975 |
| JP | S6022308 A | | 2/1985 |
| JP | H03204911 A | | 9/1991 |
| JP | H08250339 A | | 9/1996 |
| JP | H09199340 A | * | 7/1997 |
| JP | H09199340 A | | 7/1997 |
| JP | 2003077747 A | | 3/2003 |
| JP | 2005086143 A | | 3/2005 |
| JP | 2006014555 A | | 1/2006 |
| JP | 2012177149 A | | 9/2012 |
| JP | 2013087305 A | | 5/2013 |
| JP | 2015063753 A | | 4/2015 |
| KR | 950015006 B1 | | 12/1995 |
| RU | 2038638 C1 | | 6/1995 |

OTHER PUBLICATIONS

Machine Translation of JP 2012-177149 via EPO provided (Year: 2012).*
Siebert et al. "Standardization of the method of magnetostriction measurement of grain-oriented electrical steel strip and sheet", https://doi.org/10.1016/j.jmmm.2020.166644. Journal of Magnetism and Magnetic Materials. vol. 504, Jun. 15, 2020. (Year: 2020).*
Machine translation of JP H09199340 via EPO (Year: 1997).*
Sep. 3, 2019, Notification of Reasons for Refusal issued by the Japan Patent Office in the corresponding Japanese Patent Application No. 2019-510199 with English language Concise Statement of Relevance.
Apr. 22, 2021, Office Action issued by the Korean Intellectual Property Office in the corresponding Korean Patent Application No. 10-2019-7025504 with English language concise statement of relevance.
Oct. 5, 2020, Office Action issued by the Korean Intellectual Property Office in the corresponding Korean Patent Application No. 10-2019-7025504 with English language concise statement of relevance.
Aug. 24, 2021, Office Action issued by the China National Intellectual Property Administration in the corresponding Chinese Patent Application No. 201880013384.7 with English language concise statement of relevance.
Apr. 2, 2020, the Extended European Search Report issued by the European Patent Office in the corresponding European Patent Application No. 18778009.3.
Apr. 7, 2020, Notification of Reasons for Refusal issued by the Japan Patent Office in the corresponding Japanese Patent Application No. 2019-510199 with English language concise statement of relevance.
Jun. 12, 2018, International Search Report issued in the International Patent Application No. PCT/JP2018/013490.
Jan. 23, 2020, Office Action issued by the Federal Service for Intellectual Property, Patents and Trademarks of the Russian Federation in the corresponding Russian Patent Application No. 2019126206 with English language search report.
Dec. 24, 2020, Office Action issued by the China National Intellectual Property Administration in the corresponding Chinese Patent Application No. 201880013384.7 with English language search report.
Professional work in transformer, the 6th volume, Edited by Editorial Committee of Training Materials for Technical Workers of Transformers, Mar. 31, 1988.
Gu Yonghui et al., Coal Electrician Handbook, Electrician basics and electrical appliances, vol. II, 3rd edition, Aug. 31, 2013.

(Continued)

*Primary Examiner* — Mark Ruthkosky
*Assistant Examiner* — Rebecca L Grusby
(74) *Attorney, Agent, or Firm* — Kenja IP Law PC

(57) ABSTRACT

Iron core vibration and transformer noise can be reduced by using, as a transformer iron core, an iron core formed by a stack of at least two types of grain-oriented electrical steel sheets that differ in magnetostriction by $2\times10^{-7}$ or more when excited from 0 T to 1.7 T.

1 Claim, No Drawings

(56) References Cited

OTHER PUBLICATIONS

Mar. 10, 2022, Office Action issued by the China National Intellectual Property Administration in the corresponding Chinese Patent Application No. 201880013384.7 with English language search report.
Zheng Ji et al., Physical Properties of Materials, Feb. 28, 2008, Tianjin University Press, with a partial English translation.
Feb. 15, 2022, Communication pursuant to Article 94(3) EPC issued by the European Patent Office in the corresponding European Patent Application No. 18778009.3.
Jun. 22, 2022, Office Action issued by the China National Intellectual Property Administration in the corresponding Chinese Patent Application No. 201880013384.7 with English language concise statement of relevance.

* cited by examiner

TRANSFORMER IRON CORE

TECHNICAL FIELD

This disclosure relates to a transformer iron core formed by stacking a plurality of grain-oriented electrical steel sheets.

BACKGROUND

Various techniques for reducing the noise generated by transformers have been studied in the art. In particular, since the iron core is a source of noise even at no load, many technological developments have been made on the iron core and the grain-oriented electrical steel sheet used therefor, and noise improvement has been promoted.

In particular, with regard to the magnetostriction of a grain-oriented electrical steel sheet, which is a noise source, for example, JP2013-87305A (PTL 1) and JP2012-177149A (PTL 2) disclose techniques for appropriately adjusting the components, coating, crystal orientation, strain, and the like of the steel sheet.

JPH8-250339A (PTL 3) and JP2006-14555A (PTL 4) describe techniques for suppressing the vibration of an iron core by sandwiching a resin or a damping steel sheet between grain-oriented electrical steel sheets.

Further, JP2003-77747A (PTL 5) describes a technique for bonding steel sheets to suppress vibration of an iron core.

CITATION LIST

Patent Literature

PTL 1: JP2013-87305A
PTL 2: JP2012-177149A
PTL 3: JPH8-250339A
PTL 4: JP2006-14555A
PTL 5: JP2003-77747A

SUMMARY

Technical Problem

Although the above-mentioned technology makes it possible to reduce the magnetostriction and the iron core vibration, with the techniques of PTLs 1 and 2, there is a limit to the reduction of the magnetostriction and noise suppression is insufficient. Moreover, a technique involving a resin or a damping steel sheet in an iron core as described in PTLs 3 and 4 has the problem of increase of iron core size. In addition, with the technique of bonding iron cores as described in PTL 5, bonding takes time, and non-uniform stress may be applied to the steel sheet to deteriorate the magnetic properties.

It would thus be helpful to reduce the vibration of iron cores and reduce the noise of transformers by a mechanism different from those developed in the prior art.

Solution to Problem

As a result of intensive investigations, the inventors discovered that with the use of two or more grain-oriented electrical steel sheets having different magnetostriction properties for an iron core, the occurrence of the same vibration in the entire iron core can be prevented, total vibration can be reduced, and the noise of the transformer can be reduced accordingly.

The present disclosure is based on the above-described novel discovery, and summarized as follows.

A transformer iron core formed by a stack of at least two types of grain-oriented electrical steel sheets that differ in magnetostriction by $2\times10^{-7}$ or more when excited from 0 T to 1.7 T.

Advantageous Effect

According to the present disclosure, the vibration of iron cores can be reduced and the noise of transformers can be improved by a mechanism different from those developed in the prior art.

DETAILED DESCRIPTION

In the present disclosure, at least two types of grain-oriented electrical steel sheets having different magnetostriction properties are used for an iron core. As used herein, steel sheets having different magnetostriction properties refer to grain-oriented electrical steel sheets having a difference in magnetostriction when the magnetic flux density is demagnetized to 0 T and then excited to 1.7 T, where the difference in magnetostriction is $2\times10^{-7}$ or more.

Further, in the present disclosure, three or more types of grain-oriented electrical steel sheets having different magnetostriction properties can be used for an iron core. Furthermore, in the present disclosure, as long as any of the steel sheets used in the iron core has a magnetostriction difference of $2\times10^{-7}$ or more, other steel sheets may have some magnetostriction difference in between this value. However, the proportion of steel sheets having a small magnetostriction difference (i.e., having a magnetostriction difference of less than $2\times10^{-7}$) in the iron core is preferably 90% or less, more preferably 60% or less, of all steel sheets used for the iron core (which will be hereinafter simply called "the whole").

With the use of two or more types of grain-oriented electrical steel sheets having different magnetostriction properties for an iron core, different expansion and contraction occurs in each layer of the iron core. As a result, the layers having different magnetostriction properties mutually cancel the vibration, or a mechanism works to damp the vibration by friction between the layers, thereby suppressing the vibration and reducing the noise.

In contrast, when an iron core is made of grain-oriented electrical steel sheets having the same magnetostriction properties for all layers, such iron core portions (legs and yokes) that are made of grain-oriented electrical steel sheets having the same magnetostriction properties integrally provide similar vibration behavior, the amplitude tends to be large, and there is no mechanism for damping. Therefore, the effect of reducing noise can not be expected.

Here, as described above, the difference in magnetostriction between the grain-oriented electrical steel sheets according to the present disclosure needs to be $2\times10^{-7}$ or more. The reason is that if the difference is smaller than this, it is difficult for the above-described vibration suppression mechanism to work and the noise reduction effect is small. Although the upper limit for the difference in magnetostriction is not particularly provided, when the difference is too large, this follows that the absolute value of at least one of the steel sheets is large, which may cause an increase in noise. Therefore, the difference in magnetostriction is preferably $2\times10^{-6}$ or less.

Further, when the magnetostriction is divided into positive and negative, it is more preferable because the mutual vibration cancelling effect is large.

As for suitable magnetostriction in each grain-oriented electrical steel sheet, the absolute value is preferably $2\times10^{-6}$ or less in order to prevent excessive vibration of the iron core. On the other hand, the minimum value of the absolute value of the magnetostriction is not particularly limited, yet it is to be a value that can ensure the above-described difference in magnetostriction.

The reason why the change in magnetostriction is defined herein as "when excited from 0 T to 1.7 T" is that this range is effectively used as an index representing the magnetostriction properties because grain-oriented electrical steel sheets are often used at about 1.7 T for transformers (when used otherwise at a magnetic flux density below 1.7 T, noise problem would not be actualized), and because the characteristics of the magnetostriction due to the crystal orientation and the magnetic domain structure of the electrical steel sheets can prominently appear. The magnetostriction properties at 1.7 T are determined from a zero-peak value obtained by measuring the magnetostriction curve by exciting the maximum magnetic flux density to 1.7 T at 50 Hz in the rolling direction after demagnetizing a grain-oriented electrical steel sheet.

In order to obtain grain-oriented electrical steel sheets having a difference in magnetostriction, it is necessary to make the magnetic domain structure different between the grain-oriented electrical steel sheets. Specifically, the following methods may be used alone or in combination: changing the crystal orientation (e.g., using grain-oriented electrical steel sheets with different magnetic flux density $B_8$), changing the tension effect of the coating (e.g., changing the composition, thickness, and baking temperature of the insulating coating), applying strain in the steel sheets (e.g., roll-reducing steel sheets, bending back with leveler or the like, applying shot blast or water jet, applying strain by laser beam, electron beam, plasma flame, or the like) or any combination of these.

In addition, among steel sheets having a difference in magnetostriction, when the proportion of steel sheets having a certain magnetostriction in the entire iron core becomes large, the influence of the magnetostriction appears prominently, and the vibration suppression becomes insufficient. Therefore, the proportion of steel sheets having a certain magnetostriction is preferably not more than 80%, more preferably not more than 60%, of the whole.

Although there is no restriction in particular about the specific stacking form of the grain-oriented steel sheets according to the disclosure, it is preferable to switch between the type of steel sheets to be stacked twice or more in the entire thickness of the layered iron core such that steel sheets having a difference in magnetostriction are stacked on top of one another. Moreover, it is more preferable to switch between the type of steel sheets such that 1 or more and 20 or less sheets are stacked as one unit. In particular, it is more preferable to stack steel sheets such that the steel sheets of any kind of magnetostriction are dispersed as evenly as possible within the entire thickness of the layered iron core. There may be at least two types of steel sheets having different magnetostriction properties, yet there is no upper limit. Further, as described above, if the iron core contains steel sheets which differ by $2\times10^{-7}$ or more in the minimum and maximum magnetostriction, it is possible to use a steel sheet having some magnetostriction difference in between this value. The stacking order of the steel sheets at this time is not particularly limited, yet in order for the adjacent layers to cancel each other's vibration or to increase the friction between the layers, it is preferable to combine the different types of steel sheets to be stacked on top of the other so as to increase the difference in magnetostriction between the adjacent steel sheets and to increase the number of layers having a difference in magnetostriction. As used herein, when there is simply a difference in magnetostriction, it means that there is a difference in magnetostriction greater than the range of an error that is usually recognized for the information of measurement of magnetostriction. In addition, one type of steel sheet means a steel sheet having no difference in magnetostriction (also expressed as "having the same magnetostriction") within the above-described error range.

EXAMPLES

Example 1

A transformer iron core was manufactured by combining grain-oriented electrical steel sheets 1 to 3 listed in Table 1, and the noise was investigated. The transformer iron core was an iron core of stacked three-phase tripod type manufactured by shearing a coil of a grain-oriented electrical steel sheet with a width of 125 mm or 160 mm into a specimen having bevel edges. The entire core has a width of 890 mm, a height of 800 mm, and a stacking thickness of 244 mm. At this time, the iron core was formed with steel sheets having a width of 125 mm stacked on both sides of a steel sheet having a width of 160 mm. The grain-oriented electrical steel sheets 1 to 3 were obtained by performing magnetic domain refinement on a highly-oriented electrical steel sheet having a thickness of 0.23 mm by laser irradiation. The power of the laser was variously changed to obtain different magnetostriction. Specifically, a disk YAG laser beam with a focused diameter of 0.1 mm was irradiated at a scanning speed of 100 m/s linearly in the direction orthogonal to the rolling direction, the interval between the irradiation lines was set to 7.5 mm, and the output was changed in the range of from 200 W to 3000 W to alter the magnetostriction. The magnetostriction was determined from a zero-peak value obtained by measuring the magnetostriction of a steel sheet cut to a width of 100 mm and a length (in the rolling direction) of 500 mm when excited to a maximum magnetic flux density of 1.7 T at 50 Hz using a laser Doppler type magnetostriction measuring device.

Iron cores were manufactured by combining the grain-oriented electrical steel sheets 1 to 3 thus changed in magnetostriction at the usage ratio as listed in Table 1. Specifically, sheared materials of the grain-oriented electrical steel sheets 1 to 3 were prepared at the respective usage ratios listed in Table 1. Then, when assembling an iron core, two steel sheets having the same magnetostriction were combined as the minimum unit so as to have respective usage ratios in the iron core to be manufactured. When using 50% of each of the two types, two grain-oriented electrical steel sheets 1 were stacked, and then two grain-oriented electrical steel sheets 2 were stacked, and this cycle was repeated to form a layered structure. If not 50% each, while being stacked to the entire thickness, steel sheets of each type were uniformly dispersed without deviation and were stacked at respective usage ratios. An excitation coil was wound around this iron core, and the resulting iron core was excited with an alternating current of 1.7 T and 50 Hz. Then, noise was measured at locations 400 mm in height and 300 mm from the surface of the iron core (6 locations in total) on the entire surface and back of the three legs. The measured values were averaged and used as the value of noise generated from the iron core.

The magnetostriction of each grain-oriented electrical steel sheet was measured with a laser doppler vibrometer using a sample cut to a width of 100 mm and a length of 500 mm when excited from a demagnetized state (0 T) to a maximum of 1.7 T with an alternating current of 50 Hz.

As can be seen from Table 1, the iron core noise was small in all iron cores according to the present disclosure.

TABLE 1

| No. | Grain-oriented electrical steel sheet 1 | | Grain-oriented electrical steel sheet 2 | | Grain-oriented electrical steel sheet 3 | | Noise (dB) | Remarks |
|---|---|---|---|---|---|---|---|---|
| | Magnetostriction ($\times 10^{-7}$) | Usage ratio (%) | Magnetostriction ($\times 10^{-7}$) | Usage ratio (%) | Magnetostriction ($\times 10^{-7}$) | Usage ratio (%) | | |
| 1 | −3.2 | 50 | −0.5 | 50 | — | — | 52 | Example |
| 2 | 0.5 | 50 | 3.4 | 50 | — | — | 53 | Example |
| 3 | −1.8 | 50 | 0.6 | 50 | — | — | 50 | Example |
| 4 | −3.2 | 70 | −0.5 | 30 | — | — | 54 | Example |
| 5 | −3.2 | 82 | −0.5 | 18 | — | — | 55 | Example |
| 6 | −3.2 | 60 | −0.5 | 20 | 2.1 | 20 | 52 | Example |
| 7 | −2.2 | 40 | −0.6 | 20 | 1.0 | 40 | 53 | Example |
| 8 | −2.2 | 5 | −0.6 | 90 | 1.0 | 5 | 54 | Example |
| 9 | −2.2 | 20 | −0.6 | 60 | 1.0 | 20 | 52 | Example |
| 10 | −3.2 | 20 | −0.6 | 60 | 2.1 | 20 | 51 | Example |
| 11 | −2.2 | 100 | — | — | — | — | 61 | Comparative example |
| 12 | −3.2 | 50 | −1.5 | 50 | — | — | 59 | Comparative example |
| 13 | 0.5 | 50 | 2.1 | 50 | — | — | 59 | Comparative example |
| 14 | −2.2 | 60 | −1.5 | 20 | −0.5 | 20 | 60 | Comparative example |

The invention claimed is:

1. A transformer iron core formed by a stack of at least two types of grain-oriented electrical steel sheets that have different values of magnetostriction, wherein the magnetostriction values of the two types of grain-oriented electrical steel sheets differ from one another by $2\times10^{-7}$ or more and $5.3\times10^{-7}$ or less, the magnetostriction being determined from a zero-peak value obtained by measuring a magnetostriction curve by exciting a maximum magnetic flux density to 1.7 T at an alternating current of 50 Hz in the rolling direction after demagnetizing each of the grain-oriented electrical steel sheets.

* * * * *